US011769406B2

(12) United States Patent
Hamada et al.

(10) Patent No.: US 11,769,406 B2
(45) Date of Patent: Sep. 26, 2023

(54) AUTOMOBILE

(71) Applicant: TOYOTA JIDOSHA KABUSHIKI KAISHA, Toyota (JP)

(72) Inventors: Takayuki Hamada, Okazaki (JP); Masakazu Aoki, Nagoya (JP); Yohsuke Hashimoto, Nagakute (JP); Yuki Ogawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 17/820,605

(22) Filed: Aug. 18, 2022

(65) Prior Publication Data

US 2023/0063622 A1 Mar. 2, 2023

(30) Foreign Application Priority Data

Aug. 27, 2021 (JP) ..... 2021-139022

(51) Int. Cl.
*G08G 1/0969* (2006.01)
*G08G 1/0967* (2006.01)
*G08G 1/16* (2006.01)

(52) U.S. Cl.
CPC ..... *G08G 1/0969* (2013.01); *G08G 1/096725* (2013.01); *G08G 1/164* (2013.01); *G08G 1/166* (2013.01)

(58) Field of Classification Search
CPC ..... G08G 1/0969; G08G 1/096725; G08G 1/164; G08G 1/166; G08G 1/096791; G08G 1/096827; G08G 1/096775; G08G 1/137; G01C 21/00; G09B 29/00; G09B 29/10
See application file for complete search history.

(56) References Cited

U.S. PATENT DOCUMENTS 6,556,916 B2 * 4/2003 Waite ..... G08G 1/0145 340/933
2004/0246147 A1 * 12/2004 von Grabe ..... G08G 1/0104 340/995.13
2006/0220913 A1 * 10/2006 Krautter ..... G08G 1/096791 340/933

(Continued)

FOREIGN PATENT DOCUMENTS

JP 2004-233191 A 8/2004

*Primary Examiner* — Sisay Yacob

(74) *Attorney, Agent, or Firm* — Finnegan, Henderson, Farabow, Garrett & Dunner, LLP

(57) ABSTRACT

An automobile includes a traffic information acquisition device that acquires traveling vehicle information, and traffic information from a traffic information management center that manages traffic obstacle information on an obstacle on a road, a display device that displays surroundings map information of a subject vehicle together with a mark showing a current position of the subject vehicle, and a control device. The control device reflects a decorative image based on surroundings traffic obstacle information in the surroundings map information and displays the decorative image on the display device, and associates, with the decorative image, an involved vehicle number image on an involved vehicle number, and displays the involved vehicle number image on the display device. The involved vehicle number is the number of vehicles in the traveling vehicle information involved in the traffic information related to the decorative image.

5 Claims, 3 Drawing Sheets

(56) References Cited

U.S. PATENT DOCUMENTS

| | | | | |
|---|---|---|---|---|
| 2007/0050133 | A1* | 3/2007 | Yoshikawa | G01C 21/3461 701/437 |
| 2007/0225907 | A1* | 9/2007 | Oonishi | G01C 21/3602 701/411 |
| 2008/0033632 | A1* | 2/2008 | Lee | G01C 21/3632 701/117 |
| 2009/0326814 | A1* | 12/2009 | Harumoto | G01C 21/3655 701/414 |
| 2010/0036595 | A1* | 2/2010 | Coy | G08G 1/0104 701/119 |
| 2010/0268453 | A1* | 10/2010 | Otani | G01C 21/3655 701/533 |
| 2013/0282264 | A1* | 10/2013 | Bastiaensen | G08G 1/0145 701/119 |
| 2021/0063185 | A1* | 3/2021 | Kawai | G01C 21/365 |

* cited by examiner

AUTOMOBILE

CROSS-REFERENCE TO RELATED APPLICATION

This application claims priority to Japanese Patent Application No. 2021-139022 filed on Aug. 27, 2021, incorporated herein by reference in its entirety.

BACKGROUND

1. Technical Field

The present disclosure relates to an automobile.

2. Description of Related Art

An information provision server that classifies degrees of congestion in the vicinity of a current position of a member vehicle into a plurality of levels and transmits, to the member vehicle, predicted congested zones with probabilities thereof has been proposed (see, for example, Japanese Unexamined Patent Application Publication No. 2004-233191). Further, the information provision server generates display data to be displayed on a display of the member vehicle based on predicted data and transmits it to the member vehicle. Map information, a current position of the member vehicle, and congested zones are superimposed on one another and displayed on the display of the member vehicle. Further, boundary parts at which the degree of congestion is different from one another are displayed in a form in which the degree of congestion gradually changes along roads based on the probability of occurrence of each degree of congestion.

SUMMARY

However, in the above-described technology, a driver of the member vehicle can recognize a congested zone or a probability of occurrence of congestion, but cannot know which data is the basis of the congestion or the probability of its occurrence. Thus, it is difficult to more appropriately respond to congestion or the probability of its occurrence.

An automobile of the present disclosure informs a driver of at least a part of a basis of information on an obstacle that has occurred on a traveling route or on surroundings of a subject vehicle and obstructs traffic.

An automobile of the present disclosure has adopted the following elements.

An aspect of the present disclosure is an automobile. The automobile includes a traffic information acquisition device configured to acquire traveling vehicle information obtained by communication with a vehicle that is traveling and traffic information from a traffic information management center that manages information including traffic obstacle information on an obstacle obstructing traffic on a road, a display device configured to display surroundings map information including a map of surroundings of a subject vehicle together with a mark showing a current position of the subject vehicle, and a control device. The traffic obstacle information is obtained using the traveling vehicle information, the traveling vehicle information includes a current position and a vehicle speed of a vehicle, the traffic information includes surroundings traffic obstacle information, and the surroundings traffic obstacle information is the traffic obstacle information of the surroundings of the subject vehicle. The control device is configured to reflect a decorative image based on the surroundings traffic obstacle information in the surroundings map information and display the decorative image on the display device, and associate, with the decorative image, an involved vehicle number image on an involved vehicle number and display the involved vehicle number image on the display device. The involved vehicle number is the number of vehicles in the traveling vehicle information involved in the traffic information related to the decorative image.

In the automobile of the present disclosure, the traffic information acquisition device acquires the traveling vehicle information including the current position and the vehicle speed of the vehicle, which are obtained by communication with the vehicle which is traveling, and acquires the traffic information including the surroundings traffic obstacle information, which is the traffic obstacle information of the surroundings of the subject vehicle, from the traffic information management center by communicating with the traffic information management center that manages the information including the traffic obstacle information, obtained using the traveling vehicle information, on the obstacle that obstructs the traffic on the road. Further, when the surroundings map information including the map of the surroundings of the subject vehicle is displayed on the display device together with the mark showing the current position of the subject vehicle, the decorative image is reflected based on the surroundings traffic obstacle information in the surroundings map information, and displayed on the display device. As such, it is possible to reflect the surroundings traffic obstacle information in the surroundings map information as the decorative image and display the surroundings traffic obstacle information on the display device. Then, the involved vehicle number image on the number of vehicles in the traveling vehicle information involved in the traffic information related to the decorative image is associated with the decorative image and displayed on the display device. As such, it is possible to inform the driver of at least a part of the basis of the information on the obstacle that occurs on the surroundings of the subject vehicle and obstructs the traffic, and it is possible for the driver to know the number (the involved vehicle number) of the vehicles in the traveling vehicle information involved in the surroundings traffic obstacle information related to the decorative image.

In the above aspect, the involved vehicle number image may be an image of a numerical value indicating the involved vehicle number or an image of an index according to the involved vehicle number. For example, the image may be an image in which the number of bar graphs that lengthen increases as the involved vehicle number is larger.

In the above aspect, the control device may be configured to display, on the display device, a margin image of a distance according to the involved vehicle number involved in the surroundings traffic obstacle information toward a subject vehicle side from an end, closest to the subject vehicle, of the decorative image based on the surroundings traffic obstacle information. In this manner, it is possible to inform the driver of appropriateness (certainty) of the surroundings traffic obstacle information by the margin image.

In the above aspect, the margin image may be an image in which the distance tends to become shorter as the involved vehicle number is larger.

In the above aspect, the control device may be configured to set, as a deceleration control start position, a position close to the subject vehicle side from an end on the subject vehicle side of the margin image by a deceleration control distance, and start, when the subject vehicle reaches the deceleration control start position, a deceleration control. The deceleration control distance may be a distance required to set the subject vehicle to a state where the subject vehicle decelerates with appropriate deceleration and travels slowly In this manner, it is possible to more appropriately decelerate in response to traffic congestion caused by an obstacle obstructing traffic.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Next, an aspect used for executing the present disclosure will be described with reference to embodiments.

Figure 1:
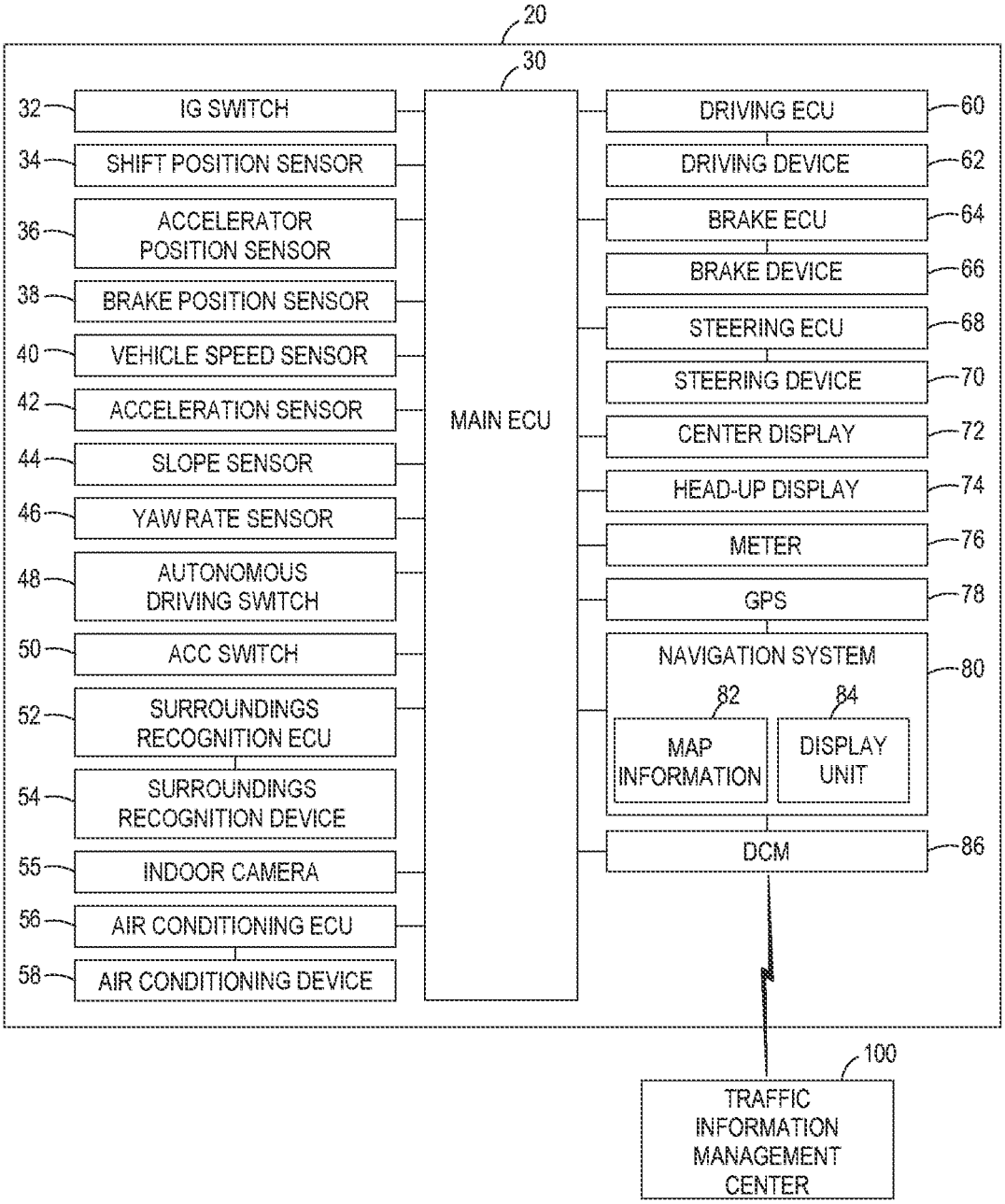
FIG. 1 is a block diagram illustrating an example of a configuration of an automobile as an embodiment of the present disclosure as a block centered on a main electronic control unit.

FIG. 1 is a block diagram illustrating an example of a configuration of an automobile 20 as an embodiment of the present disclosure as a block centered on a main electronic control unit (hereinafter, referred to as a main ECU) 30. As illustrated, the automobile 20 of the embodiment includes a driving device 62 that outputs a driving force to a driving wheel (not shown), and a driving electronic control unit (hereinafter, referred to as a driving ECU) 60 used for executing a driving control of the driving device 62.

As the driving device 62, a system having an engine and an automatic transmission, a hybrid system having an engine, a motor, and a battery, a fuel cell driving system having a fuel cell, a battery, and a motor, an electric system having a battery and a motor, and the like can be used.

Although not shown, the driving ECU 60 is composed of a microcomputer constituted with a CPU, and, in addition to the CPU, includes a ROM, a RAM, a flash memory, an input port, an output port, a communication port, or the like. The driving ECU 60 executes the driving control of the driving device 62 based on a driving control signal from the main ECU 30.

In addition to the driving device 62 or the driving ECU 60, the automobile according to the embodiment includes an ignition switch 32, a shift position sensor 34, an accelerator position sensor 36, a brake position sensor 38, a vehicle speed sensor 40, an acceleration sensor 42, a gradient sensor 44, and a yaw rate sensor 46, an autonomous driving switch 48, an active cruise control switch (hereinafter, referred to as an ACC switch) 50, an electronic control unit used for vicinity recognition (hereinafter, referred to as a vicinity recognition ECU) 52, a vicinity recognition device 54, an indoor camera 55, an electronic control unit used for air conditioning device (hereinafter, referred to as an air conditioning ECU) 56, an air conditioning device 58, a brake electronic control unit (hereinafter, referred to as a brake ECU) 64, a brake device 66, a steering electronic control unit (hereinafter, referred to as a steering ECU) 68, a steering device 70, a center display 72, a head-up display 74, a meter 76, the Global Positioning System (the Global Positioning Satellite, GPS) 78, a navigation system 80, the Data Communication Module (DCM) 86, and the like.

The shift position sensor 34 detects a position of a shift lever. The accelerator position sensor 36 detects an accelerator opening degree and the like according to an amount a driver depresses an accelerator pedal. The brake position sensor 38 detects a brake position and the like as an amount a driver depresses a brake pedal.

A vehicle speed sensor 40 detects a vehicle speed based on a wheel speed and the like. An acceleration sensor 42 detects, for example, acceleration of the vehicle in the longitudinal direction. The gradient sensor 44 detects a road surface gradient. The yaw rate sensor 46 detects lateral acceleration (a yaw rate) in the right-left direction by a turning motion.

The autonomous driving switch 48 is a switch used for selecting whether to execute autonomous driving as one of driving assistance controls. The ACC switch 50 is a switch used for selecting whether to execute an active cruise control as one of driving assistance controls. The autonomous driving switch 48 or the ACC switch 50 is attached on or near an installation panel in front of a steering wheel or a driver seat. The autonomous driving switch 48 and the ACC switch 50 also serve as switches used for executing various settings, such as setting an inter-vehicle distance with a preceding vehicle or setting a vehicle speed.

Although not shown, the vicinity recognition ECU 52 is composed of a microprocessor constituted with a CPU, and includes, in addition to the CPU, a ROM that stores a processing program, a RAM that temporarily stores data, an input/output port, or a communication port. Information of the subject vehicle or its surroundings from the vicinity recognition device 54 (for example, inter-vehicle distances D1, D2 with other vehicles in front of or behind the subject vehicle, vehicle speeds of other vehicles, a traveling position of the subject vehicle in a lane of a road surface, or the like) is input to the vicinity recognition ECU 52 via the input port. Examples of the vicinity recognition device 54 can include a front camera, a rear camera, a millimeter-wave radar, a quasi-millimeter-wave radar, an infrared laser radar, or a sonar. The indoor camera 55 is arranged in front of the driver seat and photographs a driver and an inside of a passenger compartment.

Although not shown, the air conditioning ECU 56 is composed of a microcomputer constituted with a CPU, and, in addition to the CPU, includes a ROM, a RAM, a flash memory, an input port, an output port, a communication port, or the like. The air conditioning ECU 56 is embedded in the air conditioning device 58 that conditions the air in the passenger compartment, and executes a driving control of an air conditioning compressor or the like in the air conditioning device 58 such that a temperature of the passenger compartment becomes a set temperature.

Although not shown, the brake ECU 64 is composed of a microcomputer constituted with a CPU, and, in addition to the CPU, includes a ROM, a RAM, a flash memory, an input port, an output port, a communication port, or the like. The brake ECU 64 executes a driving control of a well-known hydraulically driven brake device 66. The brake device 66 is configured to be able to execute a braking force caused by a brake pedaling force by depressing the brake pedal, and a braking force caused by hydraulic pressure adjustment.

Although not shown, the steering ECU 68 is composed of a microcomputer constituted with a CPU, and, in addition to the CPU, includes a ROM, a RAM, a flash memory, an input port, an output port, a communication port, or the like. The steering ECU 68 executes a driving control of an actuator of the steering device 70 in which a steering wheel and a driving wheel (neither shown) are mechanically connected via a steering shaft. The steering device 70 steers the driving wheel based on a driver's operation of the steering wheel, and steers the driving wheel by driving the actuator by the steering ECU 68 based on a steering control signal from the main ECU 30.

The center display 72 is arranged at the center in front of the driver seat and the passenger seat, and also functions as a touch panel. The center display 72 executes application for various vehicle settings or for audio or various media, or executes map navigation by functioning as a display unit 84 of a navigation system 80. A speaker or the like is attached to the center display 72.

The head-up display 74 provides, on a front windshield, an image (for example, by forming an image at a point at infinity) of information for the driver, and displays, for example, speed or a navigation guide. The meter 76 is embedded in, for example, an installation panel in front of the driver seat.

The GPS 78 detects a position of the vehicle based on signals transmitted from a plurality of GPS satellites.

The navigation system 80 guides the subject vehicle to a set destination, and includes map information 82 and the display unit 84. The navigation system 80 communicates with a traffic information management center 100 via the DCM 86, acquires road traffic information or acquires map information to update the map information 82, as necessary. When a destination is set, the navigation system 80 sets a route based on information of the destination, information of a current position (a current position of the subject vehicle) acquired by the GPS 78, and the map information 82.

The DCM 86 transmits information of the subject vehicle to the traffic information management center 100, or receives information of other vehicles or road traffic information from the traffic information management center 100. Examples of the information of the subject vehicle can include specifications, the current position, the vehicle speed, traveling power, or a traveling mode of the subject vehicle. In the same manner as the information of the subject vehicle, examples of the information of other vehicles can include specifications, current positions, vehicle speeds, traveling power, or traveling modes of other vehicles. Examples of the specifications of the subject vehicle or other vehicles can include a type of a vehicle (an electrified vehicle, a hybrid electric vehicle, a fuel cell electric vehicle, or the like) or a size (a length, a width, and a height of a vehicle). Examples of the road traffic information can include information on current or future congestion (including information on a start point or an end point of congestion), information on an accident, information on a falling object, information on a road surface state (including information on whether the road surface is slippery), information on traffic regulations, information on the weather, information on a map, information of other vehicles between a location at which an obstacle obstructing the traffic, such as congestion, an accident, or a falling object, has occurred and the subject vehicle. The traffic information management center 100 does not obtain information from all vehicles traveling on the road, but obtains information only from a vehicle that has a device capable of communicating with the traffic information management center 100 and a vehicle of a user who has signed a contract with the traffic information management center 100 for transmitting and receiving information of vehicles or the road traffic information. The road traffic information is generated based on information obtained from various sensors, cameras, or the like installed on a road, weather information, past traffic information, or information obtained from a vehicle which is traveling. The DCM 86 communicates with the traffic information management center 100 according to demand or at predetermined intervals (for example, every 30 seconds, every minute, or every 2 minutes).

Although not shown, the main ECU 30 is composed of a microcomputer constituted with a CPU, and, in addition to the CPU, includes a ROM, a RAM, a flash memory, an input port, an output port, a communication port, or the like. Various signals are input to the main ECU 30 via the input port. Examples of the information input via the input port can include an ignition switch signal from the ignition switch 32, a shift position from the shift position sensor 34, an accelerator opening degree from the accelerator position sensor 36, or a brake position from the brake position sensor 38. Further, the examples can also include a vehicle speed V from the vehicle speed sensor 40, acceleration from the acceleration sensor 42, a gradient from the gradient sensor 44, or a yaw rate from the yaw rate sensor 46. Further, the examples can also include an autonomous driving instruction signal from the autonomous driving switch 48 or an ACC instruction signal from the ACC switch 50. Various signals are output from the main ECU 30 via the output port. Examples of the information output via the output port can include a display control signal to the center display 72, a display control signal to the head-up display 74, or a display signal to the meter 76.

The main ECU 30 communicates with the vicinity recognition ECU 52, the air conditioning ECU 56, the driving ECU 60, the brake ECU 64, the steering ECU 68, or the navigation system 80, and exchanges various pieces of information.

The main ECU 30 sets a demanded driving force or demanded power based on the accelerator opening degree from the accelerator position sensor 36 or the vehicle speed from the vehicle speed sensor 40, and transmits the driving control signal to the driving ECU 60 such that the demanded driving force or the demanded power are output from the driving device 62 to the vehicle.

When an instruction on execution of the autonomous driving is given by the autonomous driving switch 48, the main ECU 30 selects a driver preference mode and executes the autonomous driving based on an inter-vehicle distance with a preceding vehicle, a degree of acceleration/deceleration, frequency of a lane change, and a traveling lane, which are set. For example, when a preceding vehicle is not confirmed by the vicinity recognition device 54 within a first predetermined distance (for example, 200 m or 300 m), the main ECU 30 transmits a control signal to the driving ECU 60, the brake ECU 64, and the steering ECU 68 such that the vehicle travels at a vehicle speed that is within a legal speed. On the other hand, when a preceding vehicle is confirmed by the vicinity recognition device 54 within the first predetermined distance, the main ECU 30 transmits a control signal to the driving ECU 60, the brake ECU 64, and the steering ECU 68 such that the vehicle travels within a range of a set vehicle speed at a set inter-vehicle distance with the preceding vehicle, or the vehicle changes lanes and overtakes the preceding vehicle.

When an instruction on execution of an active cruise control is given by the ACC switch 50, the main ECU 30 executes the active cruise control based on a set vehicle speed, a set inter-vehicle distance with the preceding vehicle, or the like. For example, when a preceding vehicle is not confirmed by the vicinity recognition device 54 within a first predetermined distance (for example, 200 m or 300 m), the main ECU 30 transmits a control signal to the driving ECU 60 and the brake ECU 64 such that the vehicle travels at a vehicle speed set by the ACC switch 50. On the other hand, when a preceding vehicle is confirmed by the vicinity recognition device 54 within the first predetermined distance, the main ECU 30 transmits a control signal to the driving ECU 60 and the brake ECU 64 such that the vehicle follows the preceding vehicle within a range of the vehicle speed set by the ACC switch 50 at the set inter-vehicle distance with the preceding vehicle.

Figure 2:
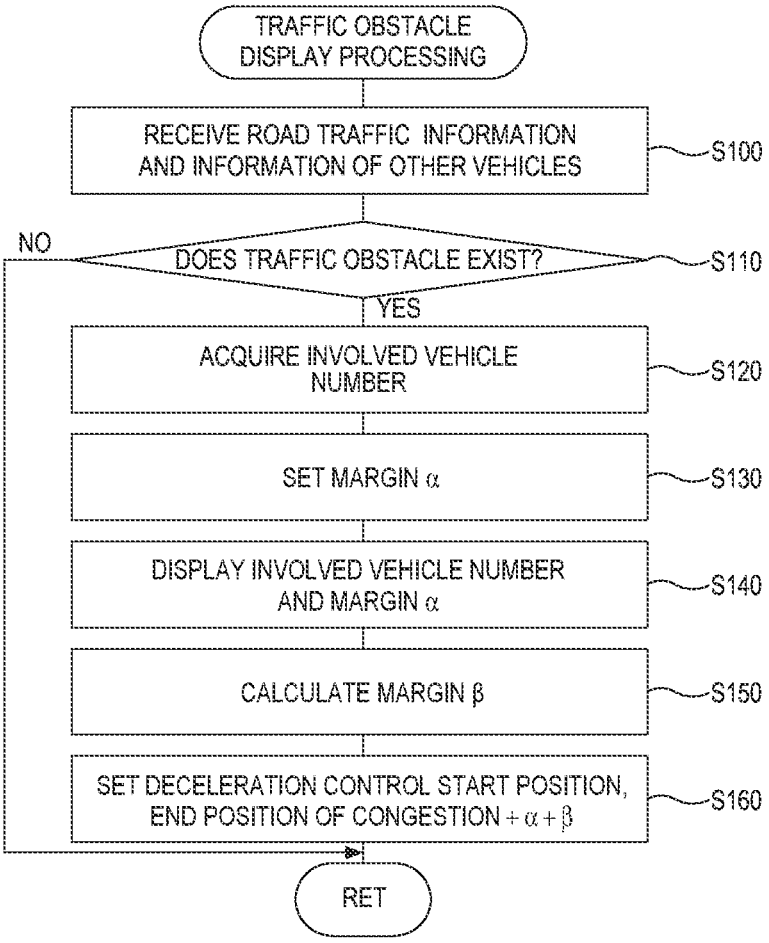
FIG. 2 is a flowchart illustrating an example of traffic obstacle display processing executed by the main electronic control unit.

Next, an operation of the automobile 20 configured in this manner, and, in particular, an operation when an obstacle obstructing the traffic has occurred on a traveling route or on the surroundings of the subject vehicle will be described. As the traveling route, when the destination is set, a route from the current position to the destination corresponds to the traveling route, and when the destination is not set, a route up to a certain range (for example, 5 km or 10 km) including a right/left turn in the traveling direction of the vehicle also corresponds to the traveling route. FIG. 2 is a flowchart illustrating an example of traffic obstacle display processing executed by the main ECU 30.

When the traffic obstacle display processing is executed, the main ECU 30 first receives road traffic information of the traveling route or on the surroundings of the subject vehicle, and information of other vehicles from the traffic information management center 100 via the DCM 86 (step S100). Subsequently, the main ECU 30 determines, based on the received road traffic information, whether an obstacle obstructing the traffic has occurred on the traveling route or on the surroundings of the subject vehicle (step S110). Examples of the obstacle obstructing the traffic can include congestion, an accident, a falling object, traffic regulations, or a slippery road state. Upon determining that no obstacle obstructing the traffic has occurred on the traveling route or on the surroundings of the subject vehicle, display or the like of an obstacle is unnecessary, and thus this processing ends.

On the other hand, in step S110, upon determining that an obstacle obstructing the traffic has occurred on the traveling route or on the surroundings of the subject vehicle, the main ECU 30 acquires the number (the involved vehicle number) of other vehicles according to the information of other vehicles involved in the generation of the traffic obstacle information, based on the road traffic information (the traffic obstacle information) on the occurrence of the obstacle and the information of other vehicles (step S120). Subsequently, the main ECU 30 sets a margin α with respect to an end position of the congestion caused by the traffic obstacle, based on the involved vehicle number (step S130). The margin α shows, as a distance, appropriateness (a certainty) of the end position of the congestion based on the involved vehicle number, and gives, as an actual end position of the congestion, a range, which is within a range obtained by adding a value (the distance of the margin α) at the end position of the congestion according to the traffic obstacle information. For this reason, the margin α is set such that it becomes a shorter distance as the involved vehicle number is larger, and conversely, it becomes a longer distance as the involved vehicle number is smaller. In other words, when the involved vehicle number is large, information of a large number of other vehicles is used in the generation of the traffic obstacle information, and thus it is determined that the appropriateness of the traffic obstacle information is high and the appropriateness of the end position of the congestion caused by the traffic obstacle is also high. Therefore, the margin α is set as a short distance. On the other hand, when the involved vehicle number is small, information of a small number of other vehicles is used in the generation of the traffic obstacle information, and thus it is determined that the appropriateness of the traffic obstacle information is low and the appropriateness of the end position of the congestion caused by the traffic obstacle is also low. Therefore, the margin α is set as a long distance.

Figure 3:
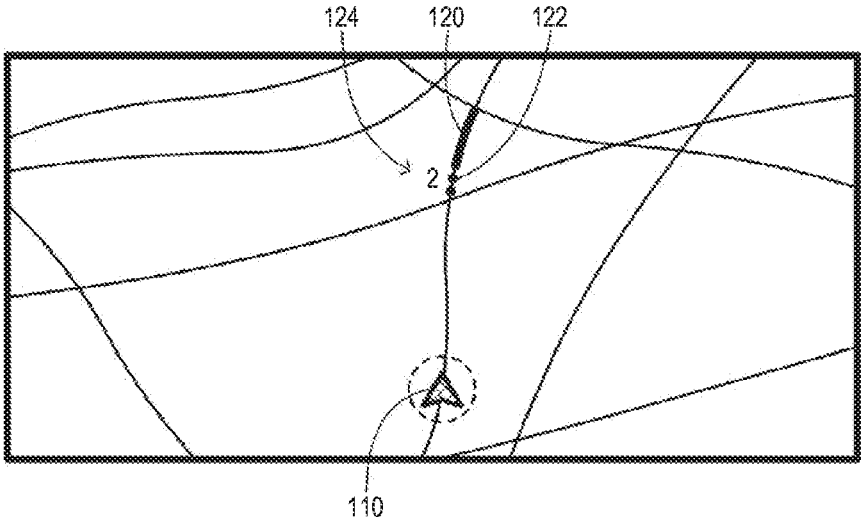
FIG. 3 is a descriptive diagram illustrating an example of a screen displaying a margin α and information on the involved vehicle number, with navigation map information, on a center display.

When the margin α is set in this manner, the main ECU 30 displays a distance of the margin α from the end position of the congestion caused by the traffic obstacle (a distance from the end position of the congestion caused by the traffic obstacle to a position that is distant from the end position by the margin α) on the center display 72 as a decorative image (for example, an image of a red thick dashed line) different from a decorative image of the congestion (for example, an image of a red thick solid line), and displays information on the involved vehicle number (an involved vehicle number image) in the vicinity of the decorative image of the congestion caused by the traffic obstacle on the center display 72 (step S140). FIG. 3 is a descriptive diagram illustrating an example of a screen displaying, on the center display 72, an image showing a navigation map information, the decorative image of the congestion, the decorative image of the margin α, and the involved vehicle number image. In the drawing, a mark surrounded by a dashed line circle is a subject vehicle mark 110, a thick solid line (for example, a red thick solid line) on a road in front of the subject vehicle mark 110 in the proceeding direction is a decorative image 120 of the congestion, a thick dashed line (for example, a red thick dashed line) extending from the end of the decorative image 120 of the congestion to the subject vehicle mark 110 side is a decorative image 122 of the margin α, and a numerical value displayed in the vicinity of the decorative image 120 and the decorative image 122 is an involved vehicle number image 124. As such, by displaying the decorative image 120 of the congestion, the decorative image 122 of the margin α, and the involved vehicle number image 124 on the image showing the navigation map information, it is possible to inform the driver, as a part of a basis of the information, of the number of other vehicles involved in the generation of the information (the traffic obstacle information) on the obstacle obstructing the traffic that has occurred on the traveling route or on the surroundings of the subject vehicle, and enable the driver to know the number (the involved vehicle number) of other vehicles involved in the traffic obstacle information.

Figure 4:
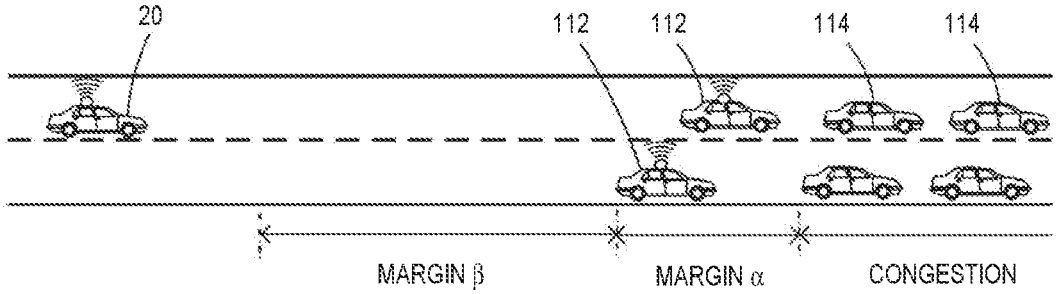
FIG. 4 is a descriptive diagram schematically illustrating an example of traffic congestion as a traffic obstacle, a margin α, and a margin β.

Subsequently, a distance (a deceleration control distance) required to set the subject vehicle to a state where it decelerates with appropriate deceleration and slows down to an extent that it can immediately stop is calculated as a margin β (step S150), and a position obtained by adding, to the subject vehicle side, the distance of the margin α and the distance of the margin β at the end position of the congestion is set as a deceleration control start position (step S160), and this process ends. The margin β may be set according to a legal speed of the road, or may be set such that it becomes longer as the vehicle speed of the subject vehicle is higher. FIG. 4 is a descriptive diagram schematically illustrating an example of the congestion as the traffic obstacle, the margin α, and the margin β. In the drawing, the automobile 20 of the subject vehicle and two other vehicles 112 are vehicles that transmit and receive information of the subject vehicle or information of the other vehicle by communication with the traffic information management center 100, and a plurality of other vehicles 114 is vehicles that do not communicate with the traffic information management center 100 regarding the information of the subject vehicle and the information of the other vehicles. In this case, the involved vehicle number is two, and the margin α is set according to the involved vehicle number. Further, the margin β is set from the vehicle speed of the subject vehicle, the legal speed, or the like, and the position obtained by adding, to the subject vehicle side, the distance of the margin α and the distance of the margin β at the end position of the congestion is set as the deceleration control start position. In step S160, when the deceleration control start position is set, a deceleration control is started when the subject vehicle reaches the deceleration control start position. The deceleration control can be implemented by the driving control of the driving device 62 by the driving ECU 62 and the driving control of the brake device 66 by the brake ECU 64 such that the automobile 20 decelerates by an appropriate deceleration force.

In the automobile 20 according to the embodiment described above, when the obstacle obstructing the traffic has occurred on the traveling route or on the surroundings of the subject vehicle, the image (the involved vehicle number image 124) of the number of other vehicles according to the information of other vehicles involved in the generation of the traffic obstacle information, which is based on the traffic obstacle information on the occurrence of the obstacle and the information of other vehicles is displayed together with the decorative image 120 of the congestion on the center display 72 such that it is placed in the vicinity of the decorative image 120 of the congestion on the image showing the navigation map information. As such, it is possible to inform the driver, as a part of the basis of the information, of the number of other vehicles involved in the generation of the information (the traffic obstacle information) on the obstacle obstructing the traffic that has occurred on the traveling route or on the surroundings of the subject vehicle.

In the automobile 20 of the embodiment, the margin α is set according to the number (the involved vehicle number) of other vehicles according to the information of other vehicles involved in the generation of the traffic obstacle information, and the distance of the margin c from the end position of the congestion caused by the traffic obstacle is displayed, on the center display 72, as the decorative image 122 different from the decorative image 120 of the congestion, using, for example, a dotted line. As such, it is possible to inform the driver of the appropriateness (the certainty) of the end position of the congestion by the decorative image 122 of the margin α.

In the automobile 20 of the embodiment, the distance (the deceleration control distance) required to set the subject vehicle to the state where the subject vehicle decelerates with the appropriate deceleration and slows down to the extent that the subject vehicle can immediately stop is calculated as the margin β, the position obtained by adding, to the subject vehicle side, the distance of the margin c and the distance of the margin β at the end position of the congestion is set as the deceleration control start position, and the deceleration control is started when the automobile 20 reaches the deceleration control start position. As such, it is possible to set the subject vehicle to the state where the subject vehicle decelerates with the appropriate deceleration and slows down to the extent that the subject vehicle can immediately stop between the end position of the congestion and the distance of the margin α. As a result, it is possible to more appropriately decelerate in response to the congestion and the like caused by an obstacle obstructing traffic.

In the automobile 20 according to the embodiment, as the involved vehicle number image, the involved vehicle number (the numerical value thereof) is displayed such that it is placed in the vicinity of the decorative image 120 of the congestion. However, the involved vehicle number image may be an instructional image according to the involved vehicle number, and may be, for example, an image in which the number of bar graphs that lengthen increases as the involved vehicle number is larger.

In the automobile 20 according to the embodiment, each device is controlled by a plurality of ECUs, such as the main ECU 30, the vicinity recognition ECU 52, the driving ECU 60, the brake ECU 64, or the steering ECU 68, but each device may be controlled by a single ECU, or each device may be controlled using a plurality of ECUs that also serve as a part of these devices.

The correspondence between the main elements in the embodiment and those of the present disclosure described in the SUMMARY has been described. In the embodiment, the traffic information management center 100 is an example of a "traffic information management center", the main ECU 30, the navigation system 80, or the DCM 86 is an example of a "traffic information acquisition device", the center display 72 is an example of a "display device", and the main ECU 30 is an example of a "control device".

The correspondence between the main elements in the embodiment and those of the present disclosure described in the SUMMARY is an example intended to specifically describe the form in which the present disclosure is implemented in the SUMMARY, and thus is not limited to the elements of the present disclosure described in the SUMMARY. In other words, the present disclosure described in the SUMMARY should be interpreted based on the description therein, and the embodiment is merely a specific example of the present disclosure described in the SUMMARY.

Although the form in which the present disclosure is implemented has been described above using the embodiment, the present disclosure is not limited thereto, and can be implemented in various forms within a range not departing from the scope thereof.

The present disclosure can be used in the automobile manufacturing industry and the like.

What is claimed is:

1. An automobile comprising:

a traffic information acquisition device configured to acquire traveling vehicle information obtained by communication with a vehicle that is traveling and traffic information from a traffic information management center that manages information including traffic obstacle information on an obstacle obstructing traffic on a road, the traffic obstacle information being obtained using the traveling vehicle information, the traveling vehicle information including a current position and a vehicle speed of the vehicle, the traffic information including surroundings traffic obstacle information, and the surroundings traffic obstacle information being the traffic obstacle information of surroundings of a subject vehicle;

a display device configured to display surroundings map information including a map of the surroundings of the subject vehicle together with a mark showing a current position of the subject vehicle; and a control device configured to:

reflect a decorative image based on the surroundings traffic obstacle information in the surroundings map information and display the decorative image on the display device; and associate, with the decorative image, an involved vehicle number image on an involved vehicle number and display the involved vehicle number image on the display device, the involved vehicle number being the number of vehicles in the traveling vehicle information involved in the traffic information related to the decorative image.

2. The automobile according to claim 1, wherein the involved vehicle number image is an image of a numerical value indicating the involved vehicle number or an image of an index according to the involved vehicle number.

3. The automobile according to claim 1, wherein the control device is configured to display, on the display device, a margin image of a distance according to the involved vehicle number involved in the surroundings traffic obstacle information toward a subject vehicle side from an end of the decorative image based on the surroundings traffic obstacle information, the end being closest to the subject vehicle.

4. The automobile according to claim 3, wherein the margin image is an image in which the distance tends to become shorter as the involved vehicle number is larger.

5. The automobile according to claim 3, wherein the control device is configured to:

set, as a deceleration control start position, a position close to the subject vehicle side from an end on the subject vehicle side of the margin image by a deceleration control distance, the deceleration control distance being a distance required to set the subject vehicle to a state where the subject vehicle decelerates with appropriate deceleration and travels slowly; and start, when the subject vehicle reaches the deceleration control start position, a deceleration control.

* * * * *